US005934826A

United States Patent [19]

Mansfield

[11] Patent Number: 5,934,826

[45] Date of Patent: Aug. 10, 1999

[54] BOAT LIFT APPARATUS

[76] Inventor: Peter W. Mansfield, #5 Chase Gayton Dr., #427, Richmond, Va. 23233

[21] Appl. No.: 09/112,490

[22] Filed: Jul. 9, 1998

[51] Int. Cl.[6] ..... B63C 3/06

[52] U.S. Cl. ..... 405/3; 114/44; 187/214; 187/267

[58] Field of Search ..... 405/3, 232, 227, 405/225, 226; 114/44; 187/203, 210, 213, 214, 267

[56] References Cited

U.S. PATENT DOCUMENTS

| | | | |
|---|---|---|---|
| 5,378,082 | 1/1995 | Hiller et al. | 405/3 |
| 5,593,247 | 1/1997 | Endres et al. | 405/3 |
| 5,628,583 | 5/1997 | Gibson | 405/3 |
| 5,772,360 | 6/1998 | Wood, II | 405/3 |
| 5,839,851 | 11/1998 | Norfolk et al. | 405/3 |

*Primary Examiner*—Tamara Graysay
*Assistant Examiner*—Sunil Singh
*Attorney, Agent, or Firm*—Charles J. Prescott

[57] ABSTRACT

A combination boat lift apparatus and piling securable to the bottom of a body of water. The boat lift apparatus includes an elongated upright outer tubular member preferably of p.v.c. tubing which has its lower end portion secured into the bottom and filled with concrete or like curable strengthening material. A drive motor is operably mounted within an upper portion near an upper end of the outer tubular member operably connected to a moveable plate mounted for slidable translation within the upper portion. An elongated longitudinally extending slot is formed through a wall of the outer tubular member for receiving a connecting portion of a boat support which is dependently connected to the moveable plate. An inner tubular member may also be provided and is preferred for added strength. The entire arrangement provides a long-lived piling structure which protectively houses the drive equipment for boat lift and support.

9 Claims, 8 Drawing Sheets

42
44
40
54
56
60
58
46
48
50
52

BOAT LIFT APPARATUS

BACKGROUND OF THE INVENTION

1. Scope of Invention

This invention relates generally to pilings and boat lifts supported on pilings and docks and more particularly to a combination boat lift apparatus and tubular piling arrangement which supports the boat lift and dock structure and method of piling installation.

2. Prior Art

Pilings for supporting a dock and for providing a tie-off boats are typically made of long wooden poles for economy. These long wooden poles or pilings may be treated in various ways to enhance the useful lifetime thereof. However, all such wooden pilings are subject to the deteriorating effects, especially salt water and brackish water which accelerate deterioration and result in heavy growth below the waterline.

Steel and concrete have been used as substitutes for the less expensive wooden piling structure, but also have significant rapid deterioration characteristics, again, especially in salt and brackish waters. Additionally, wooden pilings are also subject to upper exposed end deterioration from wildlife and weather conditions which accelerate deterioration.

All stationary boat support and boat lift apparatus require attachment and support from a piling or dock attached to the pilings. Typically, boat support apparatus include a boat cradle of some sort which may be cantilevered or supported at each end by cable, chain or rod structure associated with a motor and drive train structure for vertically positioning the boat cradle with a boat supported thereby. If such boat lift apparatus are simply attached to the exterior of a piling or dock, rapid deterioration from sun and weather conditions, again salty conditions being the worst, will reduce the useful life of these apparatus and/or certainly result in cosmetic deterioration.

The present invention discloses utilization of an inert type material such as polyvinyl chloride (pvc) plastic as the primary piling structure filled in part with concrete for reinforcement. The method of embedding the lower end portion of the hollow tubular piling into the bottom of the water is provided, along with a compact and fully concealed motor and drive train structure. The present invention further discloses a method of driving these pvc pilings with a small compact selfcontained pneumatic driving apparatus that can be placed in position for driving by one man without the need for large pole driving barges and associated equipment.

BRIEF SUMMARY OF THE INVENTION

This invention is directed to a combination boat lift apparatus and piling and method of securing same into the bottom of a body of water. The boat lift apparatus includes an elongated upright outer tubular member preferably of p.v.c. tubing which has its lower end portion secured into the bottom and filled with concrete or like curable strengthening material. A drive motor is operably mounted within an upper portion near an upper end of the outer tubular member operably connected to a moveable plate mounted for slidable translation within the upper portion. An elongated longitudinally extending slot is formed through a wall of the outer tubular member for receiving a connecting portion of a boat support which is dependently connected to the moveable plate. An inner tubular member may also be provided and is preferred for added strength. The entire arrangement provides a long-lived piling structure which protectively houses the drive equipment for boat lift and support.

It is therefore an object of this invention to provide a combination boat lift apparatus, tubular piling arrangement and method of securing the pilings into the bottom of a body of water.

It is yet another object of this invention to provide a tubular piling structure utilizing pvc plastic pipe or other inert conduit material as the primary support structure.

It is still another object of this invention to provide a method of embedding the tubular piling structure into the bottom of a body of water and to fill the embedded portion up to above the level of the bottom with reinforcing concrete or other hardenable reinforcing material.

It is still another object of this invention to provide a substantially inert piling structure which is unaffected by weathering conditions and the deteriorating effect of both fresh and salt water environments.

It is yet another object of this invention to provide a combination boat lift apparatus and tubular piling structure which houses the motor and drive train components within the upper portion of the enclosed hollow tubular piling structure.

In accordance with these and other objects which will become apparent hereinafter, the instant invention will now be described with reference to the accompanying drawings.

DETAILED DESCRIPTION OF THE INVENTION

Figure 1:
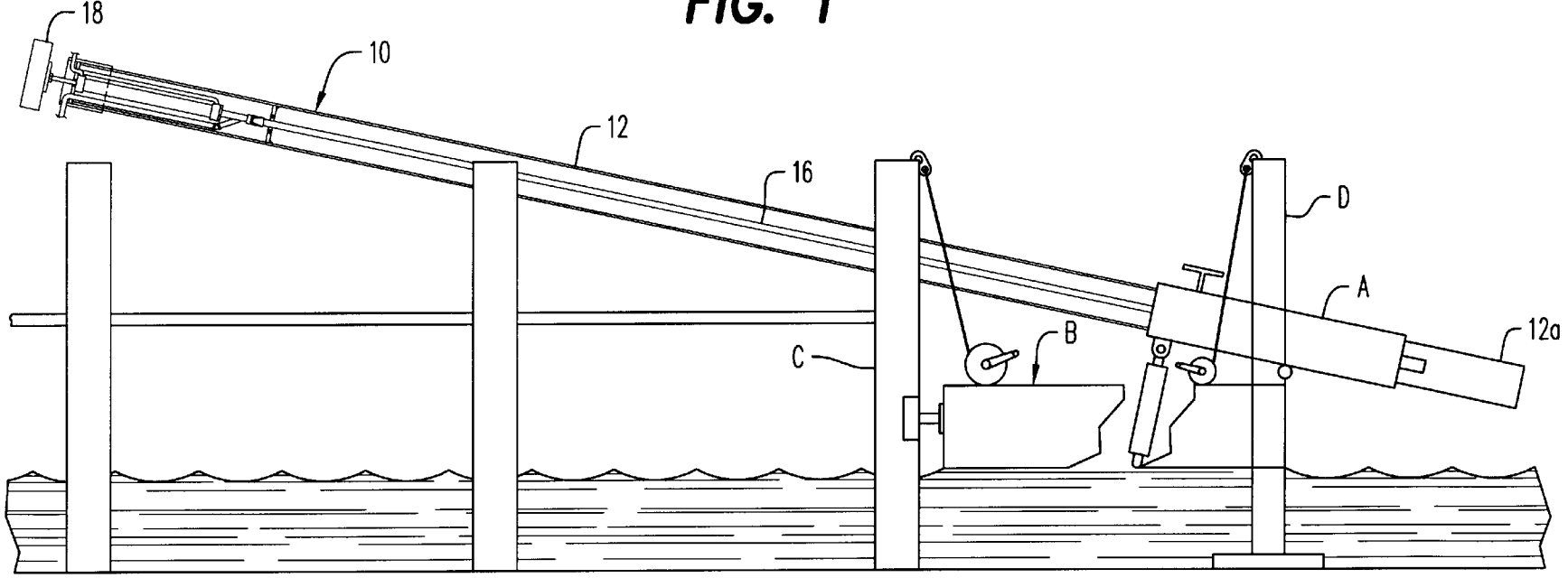
FIG. 1 is a side elevation schematic view depicting the beginning of the process of securing a tubular piling member into the bottom of a body of water according to the teachings of this invention.
Figure 2:
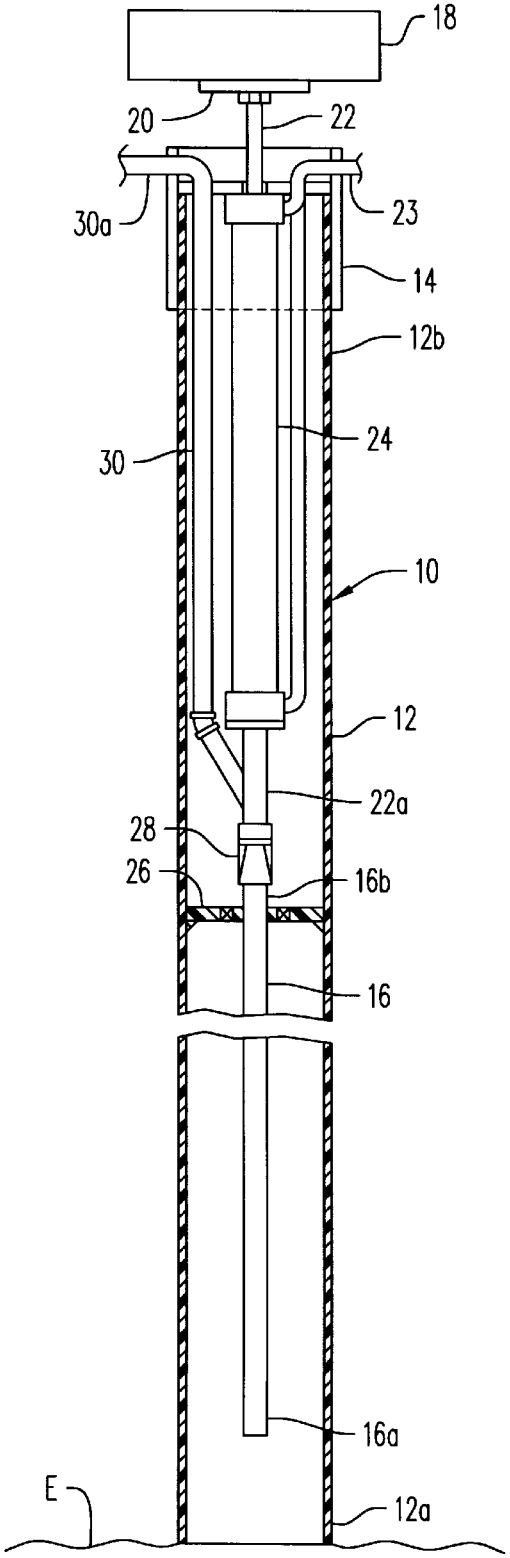
FIG. 2 is a side elevation schematic section view of the tubular piling and associated equipment for embedding the piling into the bottom of a body of water.
Figure 3:
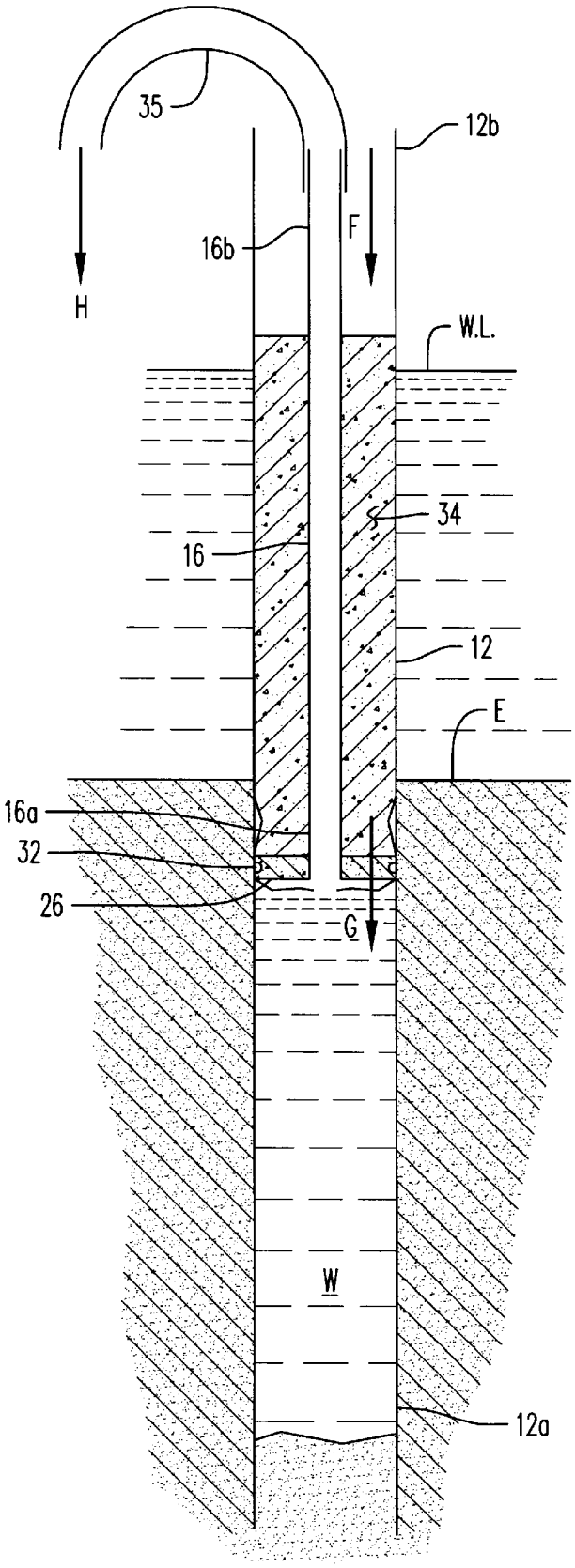
FIG. 3 is a side elevation schematic view of the process of filling the lower portion of the tubular piling with concrete after the lower end thereof has been evacuated of soil and debris from the bottom of the water utilizing the equipment shown in FIG. 2, now removed.

Referring now to the drawings and particularly to FIGS. 1 to 3, the steps of the method of deploying a tubular piling according to the invention into the bottom of a body of water are there shown. In FIG. 1, the apparatus 10 is shown being moved into an upright orientation through the use of a floating barge B. Existing pilings shown typically at C are used to stabilize the barge B, along with outriggers shown typically at D. The barge B includes a hydraulically tiltable sleeve A into which an outer tubular member 12 formed of pvc plastic pipe or tubing is positioned. The lower end portion 12*a* of the outer tubular member 12 will come to rest against the bottom of the body of water with the apparatus in an upright orientation as seen in FIG. 2.

After the apparatus 10 is in an upright orientation against the bottom E, an optional water jet stream is directed into inlet 30*a*, through conduit 30 and coupling 28 for downward discharge through a jet p ipe 16. The jet pipe 16 is supported through a water jet alignment guide plate 26 at the upper end 16*b* of the jet pipe 16. Care must be taken not to blow around and out of the pvc pipe 12.

Although the water jet arrangement above described is sufficient to dislodge the bottom material from below and within the outer tubular member 12 so as to implant or submerge the lower end portion 12*a* into the bottom E as shown in FIG. 3, a separate air impact arrangement 24 is also provided. This air impact mechanism 24 includes a collar 14 resting atop the upper end of the outer tubular conduit 12. A heavy weight 18 is supported atop a level block 20 which is connected to an upright shaft 22 of the air impact cylinder 24. By pressurizing the air cylinder 24, the weight 18 rises to the full extent of shaft 22. Air is then switched to inlet tube 23 which, along with the gravitational fall of weight 18, helps to blow the rod 22 down, thereby adding to the impact of weight 18 against the collar 14. By this arrangement, air impulses through inlet tube 23, combined with the heavy weight 18, will quickly drive the lower end portion 12*a* of the outer tubular member 12 into the water bottom E a distant sufficient for proper supportive stabilization thereby.

In FIG. 3, after substantially all of the bottom material has been evacuated from within the lower portion 12*a* of the tubular conduit 12 using a commercially available pump and the air impact cylinder 24 and water jet equipment having been removed, a concrete disc 26 complete with an o-ring 32 and evacuation tube 16, are pushed down the pvc pipe 12, which displaces the water up the evacuation tube 16 to discharge tube 35, leaving a dry hollow pipe 12. A quantity of uncured concrete or other heavy curable material shown at 34 is poured into the upper open end portion 12*b* in the direction of arrow F. The weight of this uncured concrete 34 is such that the concrete disc 26 will be forced downwardly in the direction of arrow G in sliding sealed fashion within the inner wall surface of the outer tubular member 12. Any water W still present within the lower portion 12*a* is also evacuated upwardly within the evacuation tube 16 for discharge in the direction of arrow H from a flexible discharge hose 35. By this arrangement, virtually all of the water W is evacuated and replaced with curable concrete 34 which adds strength and integrity to the entire submerged portion of the outer tubular member 12 once the concrete 34 is properly cured. The concrete disc 26 and evacuation tube 16 are permanently left at the bottom of the concrete near the lower end of outer tubular member 12. If it is desired to later remove this piling, a lifting force will be developed by pressurizing the evacuation tube 16.

Figure 4:
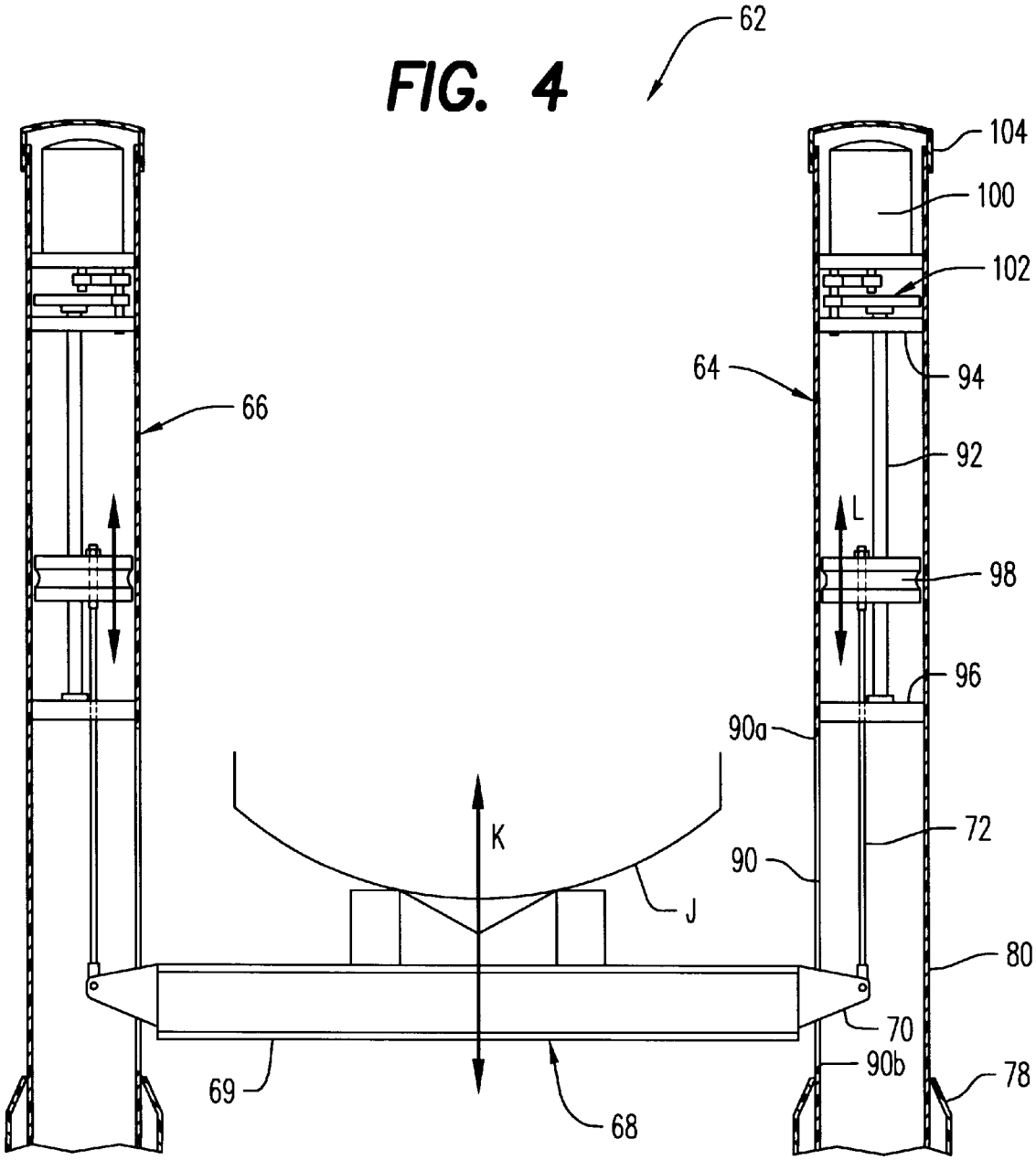
FIG. 4 is a simplified side elevation section view of one embodiment of the invention.

Referring now to FIG. 4, one embodiment of a combination boat lift apparatus and tubular piling structure is there shown generally at numeral 62. This combination 62 includes a boat lift 68 comprised of an elongated horizontally extending support cradle 69 for securely supporting the hull J of a boat and end plates 70. The intended movement of the boat cradle 68 is vertically in either direction in the direction of arrow K with respect to quarter line W.L. as desired.

Each of the pilings 64 and 66 are embedded into the bottom of the water (not shown in FIG. 4) as previously described and support each respective end plate 70 of the boat cradle 68. For simplicity, the tubular piling 64 will be described, piling 66 being identical thereto. Tubular piling 64 includes an elongated pvc plastic tubular member 80 which defines the exposed above water portion of the piling 64 and the larger diameter tubular member 12 connected to tubular member 80 by a reducer 76 as better described with respect to FIG. 5 herebelow. A drive motor 100 is mounted adjacent the upper end of tubular member 80 below which a conventional gear train arrangement 102 is supported on fixed transverse plate 94. An ACME-type screw drive member 92 downwardly extends from the drive train 102 and is supported at its lower end by a fixed support plate 96 and associated support bearing. The rotatable drive shaft 92 moves a moveable plate 98 which preferably provides an electrical insulator between drive shaft 92 and tension cable 72, by threaded engagement up and down in the direction of arrow L in response to motor 100 activation. An upper removable sealing cap 104 renders the entire upper hollow portion of tubular member 80 weather resistant.

A chain, cable or rod 72 rigidly connected at its upper end to the moveable plate 98 downwardly extends to support the end plate 70 of the boat cradle 68. An elongated longitudinally extending slot 90 is formed into the tubular member 80 which extends from 90*a* to 90*b*. This slot 90 provides the necessary sliding clearance of the end plate 70 to chain 72 to effect upward and downward movement in the direction of arrow K.

Figure 5:
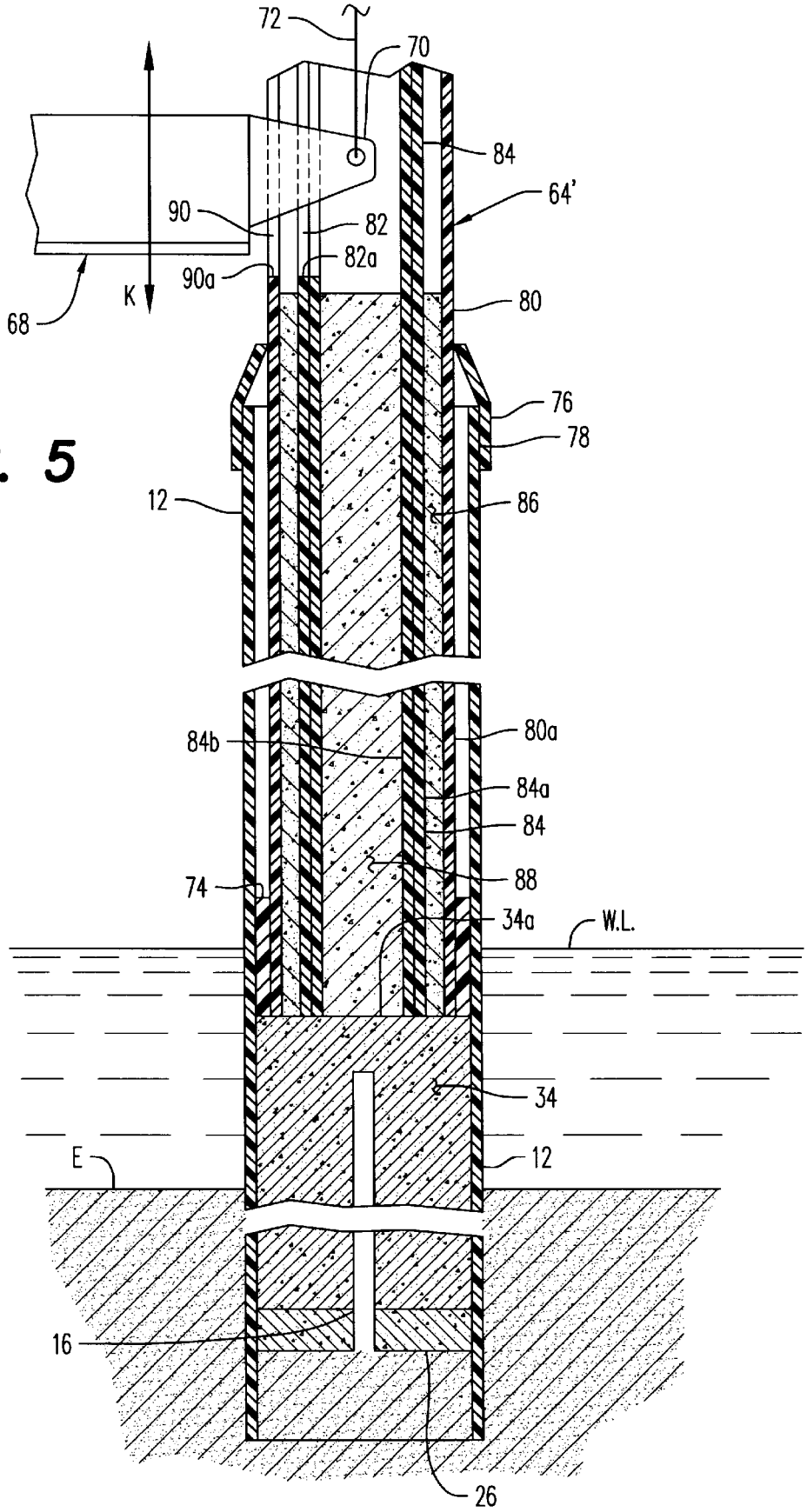
FIG. 5 is a side elevation section view of a portion of another embodiment of the invention.

Referring to FIG. 5, a lower portion of a modified piling 64' includes the larger diameter outer tubular (preferably 10") pvc plastic conduit 12 which has been embedded into the bottom E as previously described. A pvc bell-shaped reducer 76 provides stabilizing and concentric aligning attachment between the tubular member 80 and the outer tubular member 12. The reducer 76 is adhered to the upper end of the outer tubular member 12 only along circumferential surface 78. The lower end of tubular member 80 is rested atop the upper surface 34*a* of the cured concrete 34 as previously described. An annular alignment collar 74 insures tight and supportive concentric alignment of the lower end of tubular conduit 80.

In this piling apparatus 64' an additional reinforcing structure is also provided which defines an inner tubular member 84, the tubular member 80 becoming an intermediate tubular member at its lower portion 80*a*. The inner tubular member 84 is formed of two concentrically aligned closely mating pvc tubular members 84*a* and 84*b*. The tubular member 84*a* is slit lengthwise and spread apart to effect a close and secure wrapped alignment around tubular member 84*b*, the lower portion thereof filled with curable concrete at 88. The cylindrical void between the inner tubular member 84 and the intermediate tubular portion 80*a* is also filled with a curable concrete 86 for stabilization and added reinforcement against flexure forces produced by the weight of the boat atop the cradle 68.

Again, a longitudinal slot 90 is formed into the tubular member 80 as previously described which is aligned and registered and generally coextensive with a separate longitudinal slot 82 formed through the wall of the tubular member 84 so as to provide clearance access and ease of vertical movement in the direction of arrow K of the cradle 68 and its end blade 70.

Figure 6:
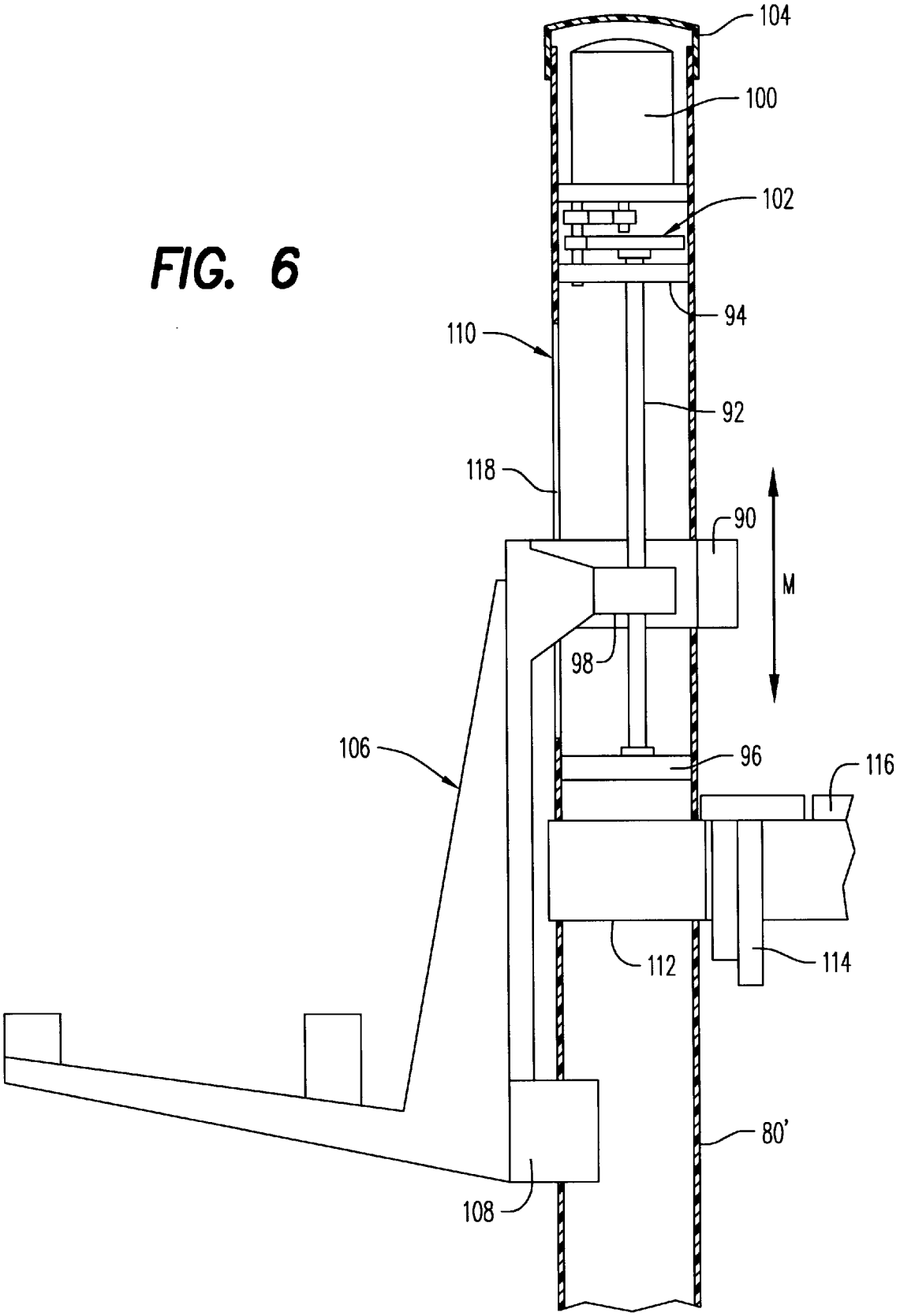
FIG. 6 is a side elevation view of an upper portion of still another embodiment of the invention attached to a dock structure.

Referring now to FIG. 6, another embodiment of the invention is generally shown at numeral 110 providing an outer tubular piling 80' formed of pvc plastic conduit as previously described. A boat cradle shown generally at numeral 106 in the form of a cantilevered boat lift is operably connected as herebelow described so as to move up and down in the vertical direction of arrow M.

A drive motor 100, gear train arrangement 102 and ACME screw drive shaft 92 are provided as previously described and mounted in the upper portion of the tubular member 80'. The drive shaft 92 is threadedly engaged through moveable support 98 which moves vertically in the direction of arrow M in response to rotational driving input of the drive shaft 92. A lower support plate 96 fixed within the tubular member 80' stabilizes and supports the lower end of drive shaft 92.

The boat lift 106 extends into the hollow interior of the tubular member 80' through upright longitudinally extending slot 118. Collar 90 slidably fitting around tubular member 80' helps to stabilize the boat lift 106 from undesired rotation about the vertical axis of the drive shaft 92. Additionally, saddle 108 extending part way around tubular member 80' further stabilizes the boat lift 106 from rotational and any side-to-side or swinging movement either at rest or when being vertically repositioned. The lower end portion of tubular member 80' is similar to that described in FIG. 3. One example of an interconnecting means between the piling 110 and a dock structure is also shown in the form of a collar 112 tightly secured around tubular member 80' which is interconnected to upright joists 114 supporting the dock planking 116.

Figure 7:
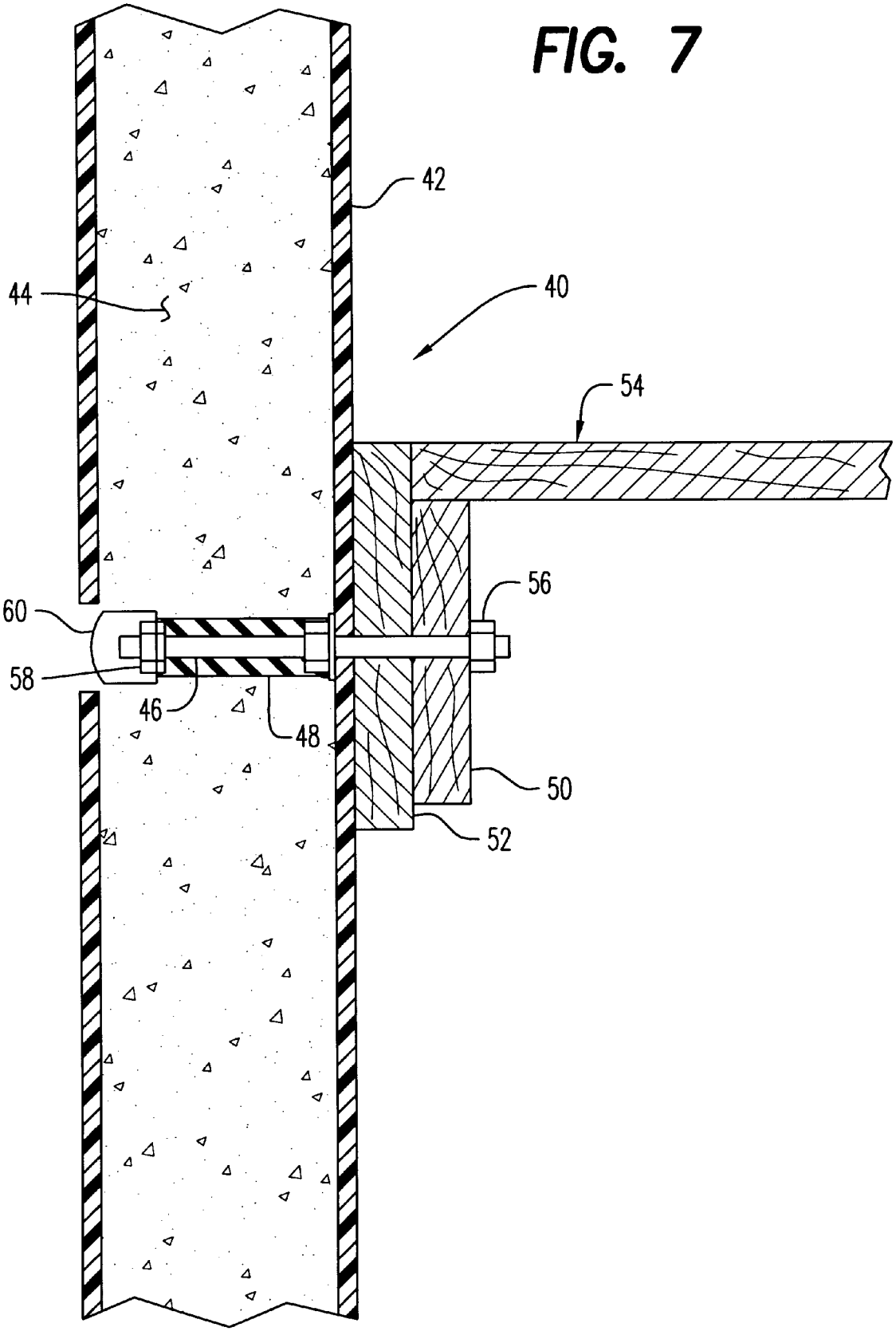
FIG. 7 is an enlarged section view of a portion of an alternate embodiment of an upright tubular piling filled with concrete and demonstrating one means for attachment to a dock.

Referring to FIG. 7, one embodiment of a connecting means between a portion of a concrete-filled piling 42 to a dock arrangement 54 is there shown. The tubular member 42 is filled with cured concrete 44. A pvc sleeve 48 is either cast embedded with the uncured concrete 44 or positioned into a suitable hole drilled for its receipt after the concrete 44 is cured. An elongated bolt 46 with its head 58 against one end of the pvc sleeve 48 extends outwardly through the opposite side of the tubular member 42 as shown for clamping threaded engagement into dock stringers 50 and 52 and secured there by nut 56. A protective cap 60 is held in place over the head 58 for environmental protection.

Figure 8:
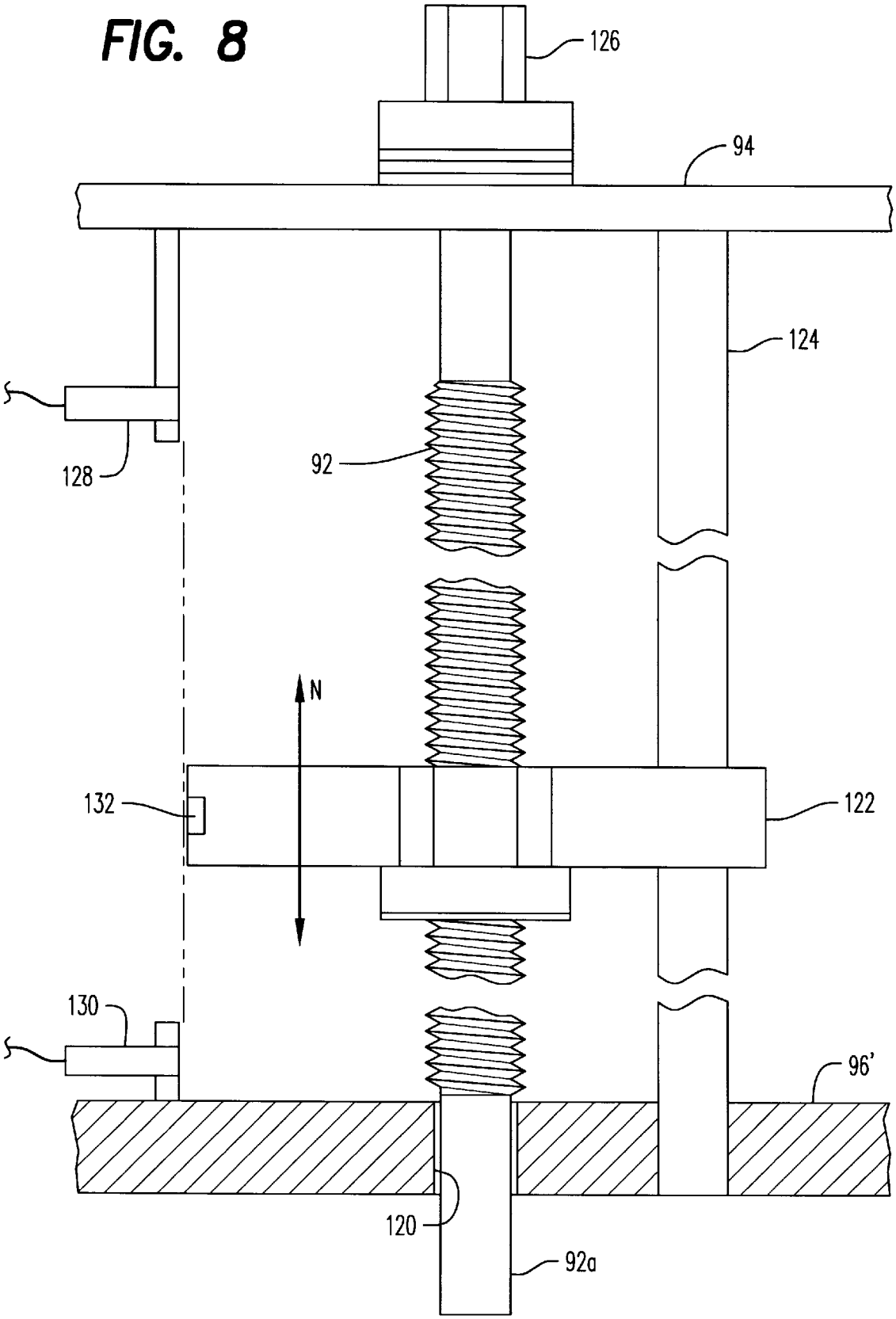
FIG. 8 is a side elevation schematic view of the preferred output drive shaft arrangement which supports and vertically positions a boat lift cradle.

Referring now to FIG. 8, the preferred embodiment of the drive shaft and moveable plate arrangement is there shown and is held in position within the hollow upper portion of a tubular piling member 80 or 80' (not shown for clarity) as previously described. The upper plate 94 fixed within the tubular member (not shown) supports a hex drive end 126 of the ACME screw drive shaft 92. This hex drive 126 operably engages into the drive train arrangement 102 of FIGS. 4 and 7 (not shown) previously described. The lower unthreaded end 92*a* of the drive shaft 92 is supported within a mating aperture 120 or, preferably a bearing (not shown) of the lower fixed support plate 96'. As the drive shaft 92 rotates in either direction, vertical movement of the moveable plate 122 in the direction of arrow N is effected. A guide bar 124 which extends between the motor mount plate 94 and the lower support plate 96' prevents rotation of the moveable plate 122.

A magnet 132 is embedded within the end of the moveable plate 122 in vertical alignment with magnetic switches 128 and 130. Thus, when the moveable plate 122 is moved to its upper or lower position limits, the corresponding REED switch 128 or 130, respectively, interrupt power to the drive motor stopping further movement of the moveable plate 122.

Figure 9:
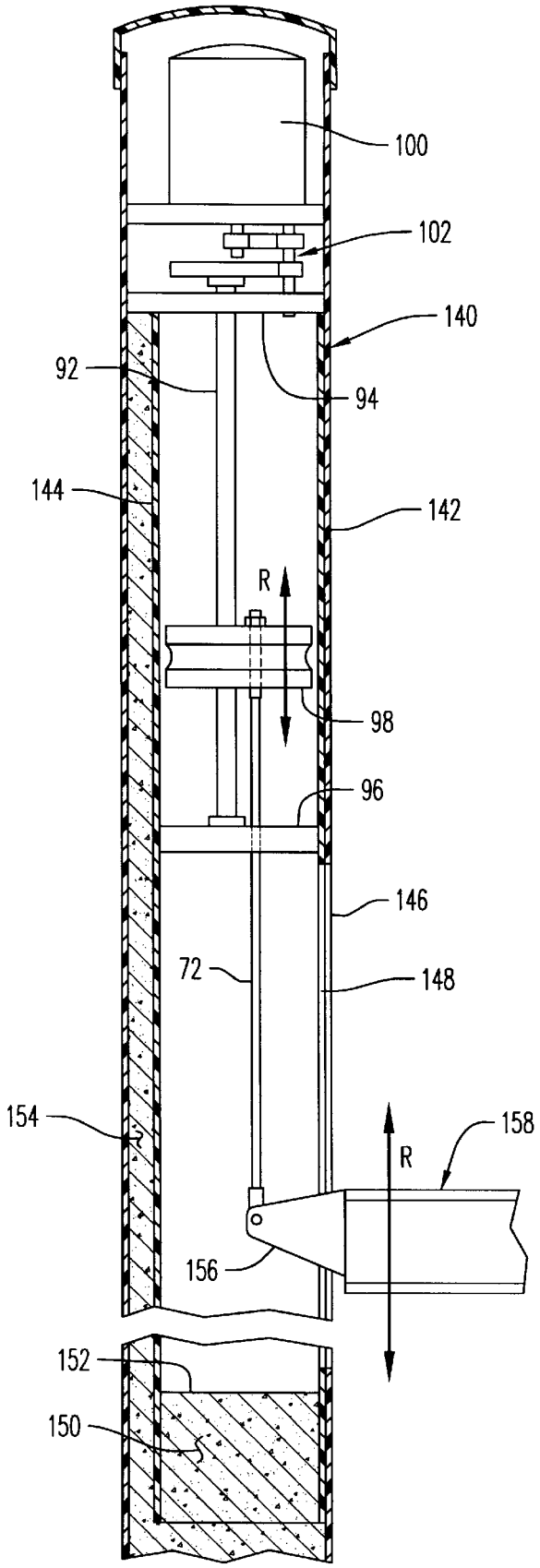
FIG. 9 is a side elevation section view of the preferred embodiment of the piling structure of the invention.

Referring lastly to FIG. 9, the preferred embodiment of the piling apparatus is shown generally at numeral 140. This embodiment 140 includes a drive motor, gear reduction arrangement 102 and a threaded rotational output shaft 92 downwardly extending as previously described which, when operated by motor 100, serve to move the boat lift 158 in the direction of arrow R. However, in this embodiment 140, an inner tubular member 144, also made of pvc plastic conduit, is secured within the outer tubular member 142 in a non-concentric fashion. The inner tubular member 144 extends from the motor support plate 94 at its upper end downwardly and is cast and secured into concrete 150 at its lower end before the concrete is cured. The inner tubular member 144 is secured in an offset or non-concentric position with longitudinally extending slots 146 and 148 are aligned and coextending against one another along each of the inner and outer tubular members 144 and 142, respectively. Again, this upright slot 146/148 provides clearance and smooth vertical movement for an outer blade 156 of the boat cradle 158, each outer blade 156 being supported by cable 72.

The eccentrically shaped cavity between the inner and outer tubular members 144 and 146 is also filled with cured concrete 154 for added strength and stability over the entire length of the inner tubular member 144. A sleeve may be temporarily sealingly secured around the central portion of the outer piling 142 to prevent uncured concrete from leaking out of the slots 146/148.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A combination boat lift apparatus and tubular piling secured into a bottom of a body of water, comprising:

an upright, elongated outer tubular member, a lower portion thereof being embedded into, and receiving support from, the bottom, said lower portion substantially filled with a cured aggregate reinforcement;

a moveable plate mounted for substantially vertical translation within a substantially hollow upper portion of said outer tubular member;

motor means mounted within said upper portion operably connected to said moveable plate for selectively moving said moveable plate up and down within said upper portion;

a boat support dependently connected to said moveable plate and positioned substantially externally to said outer tubular member, said boat support structured for supporting and vertically positioning a boat responsive to movement of said moveable plate.

2. A combination boat lift apparatus and tubular piling as set forth in claim 1, further comprising:

an inner reinforcing tubular member extending within said outer tubular member upwardly from said aggregate reinforcement to said motor means;

said moveable plate being mounted for substantially vertical translation within a substantially hollow upper portion of said inner tubular member.

3. A combination boat lift apparatus and tubular piling as set forth in claim 2, wherein:

a lower portion of said inner tubular member is also substantially filled with said cured aggregate reinforcement.

4. A combination boat lift apparatus and tubular piling secured into a bottom of a body of water, comprising:

an upright, elongated substantially cylindrical outer tubular member formed of a substantially inert, non-corrosive material;

a lower portion of said tubular member embedded into, and receiving support from, the bottom, said lower portion substantially filled with a cured aggregate reinforcement substantially free of bottom soil;

a moveable plate mounted for substantially vertical translation within a substantially hollow upper portion of said outer tubular member;

a drive motor mounted and concealed substantially entirely within said upper portion adjacent an upper end thereof;

a power transfer arrangement mounted within said upper portion between said moveable plate and said drive motor for selectively moving said moveable plate up and down within said upper portion;

a boat support dependently connected to said moveable plate through an elongated narrow outer slot formed longitudinally in said outer tubular member and positioned substantially externally to, and laterally extending from, said outer tubular member, said boat support structured for supporting and vertically positioning a boat responsive to movement of said moveable plate.

5. A combination boat lift apparatus and tubular piling as set forth in claim 4, further comprising:

an inner reinforcing tubular member extending within said outer tubular member upwardly from said aggregate reinforcement to said motor means;

said moveable plate being non-conducted, is mounted for substantially vertical translation within a substantially hollow upper portion of said inner tubular member;

said inner tubular member including an elongated narrow inner slot formed longitudinally in said inner tubular member and positioned in alignment with said outer slot for said boat support moveably positioned therethrough.

6. A combination boat lift apparatus and tubular piling as set forth in claim 5, wherein:

a lower portion of said inner tubular member is also substantially filled with said cured aggregate reinforcement.

7. A combination boat lift apparatus and tubular piling as set forth in claim 6, wherein:

said inner tubular member positioned non-concentrically with respect to said outer tubular member, whereby said inner and outer slots are positioned and held against one another.

8. A boat lift apparatus, comprising:

an elongated outer tubular member, a lower portion thereof receiving support when embedded into a bottom of a body of water and being substantially filled with a cured aggregate reinforcement;

a moveable plate mounted for substantially longitudinal translation substantially entirely within a substantially hollow upper portion of said outer tubular member;

motor means mounted substantially entirely within said upper portion operably connected to said moveable plate for selectively moving said moveable plate up and down within said upper portion;

a boat support dependently connected to said moveable plate and positioned substantially externally to said outer tubular member, said boat support structured for supporting and vertically positioning a boat responsive to movement of said moveable plate.

9. A boat lift apparatus, comprising:

an upright, elongated substantially cylindrical outer tubular member formed of a substantially inert, non-corrosive material;

a moveable plate mounted for substantially vertical translation substantially entirely within a substantially hollow upper portion of said outer tubular member;

a drive motor mounted and concealed substantially entirely within said upper portion adjacent an upper end thereof;

a power transfer arrangement mounted substantially entirely within said upper portion between said moveable plate and said drive motor for selectively moving said moveable plate up and down within said upper portion;

a boat support dependently connected to said moveable plate through an elongated narrow outer slot formed longitudinally in said outer tubular member and positioned substantially externally to, and laterally extending from, said outer tubular member, said boat support structured for supporting and vertically positioning a boat responsive to movement of said moveable plate.

* * * * *